US005960875A

United States Patent [19]

Beauquin et al.

[11] Patent Number: 5,960,875

[45] Date of Patent: Oct. 5, 1999

[54] ELECTRIC PUMP HAVING A LINEAR MOTOR

[75] Inventors: Jean-Louis Beauquin, Saint-Faust; Jean Jacquart, Lescar, both of France

[73] Assignee: Elf Exploration Production, France

[21] Appl. No.: 08/952,490

[22] PCT Filed: Mar. 27, 1997

[86] PCT No.: PCT/FR97/00561

§ 371 Date: Feb. 11, 1998

§ 102(e) Date: Feb. 11, 1998

[87] PCT Pub. No.: WO97/37131

PCT Pub. Date: Oct. 9, 1997

[30] Foreign Application Priority Data

Mar. 29, 1996 [FR] France ..... 96/03999

[51] Int. Cl.[6] ..... E21B 4/04

[52] U.S. Cl. ..... 166/66.4; 166/66.6; 166/66.7; 417/418

[58] Field of Search ..... 166/66.6, 66.4, 166/66.7, 65.1; 417/47, 418

[56] References Cited

U.S. PATENT DOCUMENTS

| | | | |
|---|---|---|---|
| 1,840,994 | 1/1932 | Winsor . | |
| 4,562,385 | 12/1985 | Rabson | 318/135 |
| 4,687,054 | 8/1987 | Russell et al. | 166/66.4 |
| 4,815,949 | 3/1989 | Rabson | 417/417 |
| 4,926,942 | 5/1990 | Profrock, Jr. | 166/250 |
| 4,928,771 | 5/1990 | Vandevier | 166/385 |
| 5,049,046 | 9/1991 | Escue et al. | 166/66 X |
| 5,193,985 | 3/1993 | Escue et al. | 166/66 X |
| 5,196,770 | 3/1993 | Champs et al. | 166/66.4 X |
| 5,620,048 | 4/1997 | Beauquin | 166/66.4 X |

FOREIGN PATENT DOCUMENTS 1 442 737 7/1976 United Kingdom .

*Primary Examiner*—Roger Schoeppel
*Attorney, Agent, or Firm*—Bacon & Thomas, PLLC

[57] ABSTRACT

An electric pump including a linear motor consisting of a stator and a moving element driven by the electromagnetic field generated by the stator, and a pump piston driven by the linear motor, is disclosed. The piston is arranged inside the stator of the electric pump and forms the moving element of the linear motor. An oil well facility provided with such an electric pump is also disclosed.

7 Claims, 2 Drawing Sheets

ELECTRIC PUMP HAVING A LINEAR MOTOR

BACKGROUND OF THE INVENTION

1. Field of the Invention

The present invention relates to an electric pump having a linear motor, and more particularly to such an electric pump intended to be installed at the bottom of a well, for example an oilwell.

2. Description of Related Art

In some oilwells, the natural flow of hydrocarbons from the bottom to the surface proves to be insufficient to allow or maintain commercial production. This is due either to the high viscosity of the hydrocarbons, or too low a natural pressure at the bottom of the well, or else to a combination of the two. In order to enable the well to be brought into production on a commercial scale, a well-assistance system or well-stimulation system may be used. For example, it is possible to place a pump on the lower end of production tubing located in the well.

Rod pumping units have already been proposed, which consist of a downhole positive-displacement pump fitted in the tubing, the piston of which is driven in translational motion from the surface by means of steel or glass-fibre rods. On the surface, the motion is imparted to the string of rods by a structure having a mule head driven by a rotary electric motor or else a hydraulic power cylinder.

The deadweight, inertia, friction and mechanical fatigue of the rods limit the pumping capacity and performance of these systems. They are ill-suited to blowing wells on which downhole safety devices are required, to deep wells or to high output levels (greater than 200 $m^3$/d of liquid).

Alternatively, the pump may be driven by a submerged electric motor at the bottom of the well, which is supplied via a cable placed in the annular space between the tubing and the casing of the well.

An example of this type of pump is given in document U.S. Pat. No. 4,928,771 which describes a rotary pump driven by an electric motor placed in the well above the pump. This type of pump has drawbacks, firstly because it is bulky, the pump and the motor forming two separate units, and, in addition, because the two units are submerged in the fluid flowing in the well. This fluid constitutes an aggressive medium which is the cause of a large number of breakdowns experienced by this type of pump.

Electric pumps driven by linear motors have also been proposed. In such pumps, a linear electric motor sets in motion the piston of a reciprocating pump. Document U.S. Pat. No. 4,687,054 describes an electric pump having a linear motor, intended to be placed at the bottom of an oilwell, the linear motor being placed above the pump which forms a separate subassembly. The fact that the motor and the pump form two separate subassemblies makes the electric pump bulky and heavy. The operations of fitting the electric pump into the well, operations which are effected by cable or by means of a small-diameter tube, and its periodic removal for maintenance, are made more difficult and laborious by the presence of the two subassemblies and by their weight. In addition, an electric pump formed by two sub-assemblies has a high inertia and, moreover, the connection between the sub-assemblies constitutes a weak point in the electric pump.

SUMMARY OF THE INVENTION

The subject of the present invention is therefore an electric pump having a linear motor which is simple to construct, compact and reliable and which makes it possible to remedy the drawbacks mentioned above.

In order to achieve this objective, the invention provides an electric pump which comprises a linear motor, formed by a stator and a moving component which can be moved under the effect of the electromagnetic field generated by the stator, a pump piston which can be moved by the linear motor inside the stator of the electric pump and constituting the moving component of the linear motor, the piston including a non-return valve, the electric pump comprising, in addition, a non-return valve fixed in relation to the piston, characterized in that the non-return valve is placed on the end of the piston so as to reduce to a minimum the dead volume between the two non-return valves and of a moving component which can be moved under the effect of the electro-magnetic field generated by the stator, and a pump piston which can be moved by the linear motor, characterized in that the piston is placed inside the stator of the electric pump and constitutes the moving component of the linear motor.

The invention also provides a plant for an oilwell, extending from the surface to an oil-bearing rock stratum, which comprises a tubing placed in the well and forming a flow channel to the surface for hydrocarbons coming from the oil-bearing rock stratum, a pump placed in the tubing and comprising a piston, forming the moving component of a linear motor, the piston including a non-return valve, the plant comprising, in addition, a non-return valve which is fixed relative to the piston, characterized in that the non-return valve is placed on the end of the piston so as to reduce to a minimum the dead volume between the two non-return valves.

Other characteristics and advantages of the present invention will emerge upon reading the following description, given by way of explanation but implying no limitation, in conjunction with the appended drawings.

DETAILED DESCRIPTION OF THE PREFERRED EMBODIMENT

Figure 1:
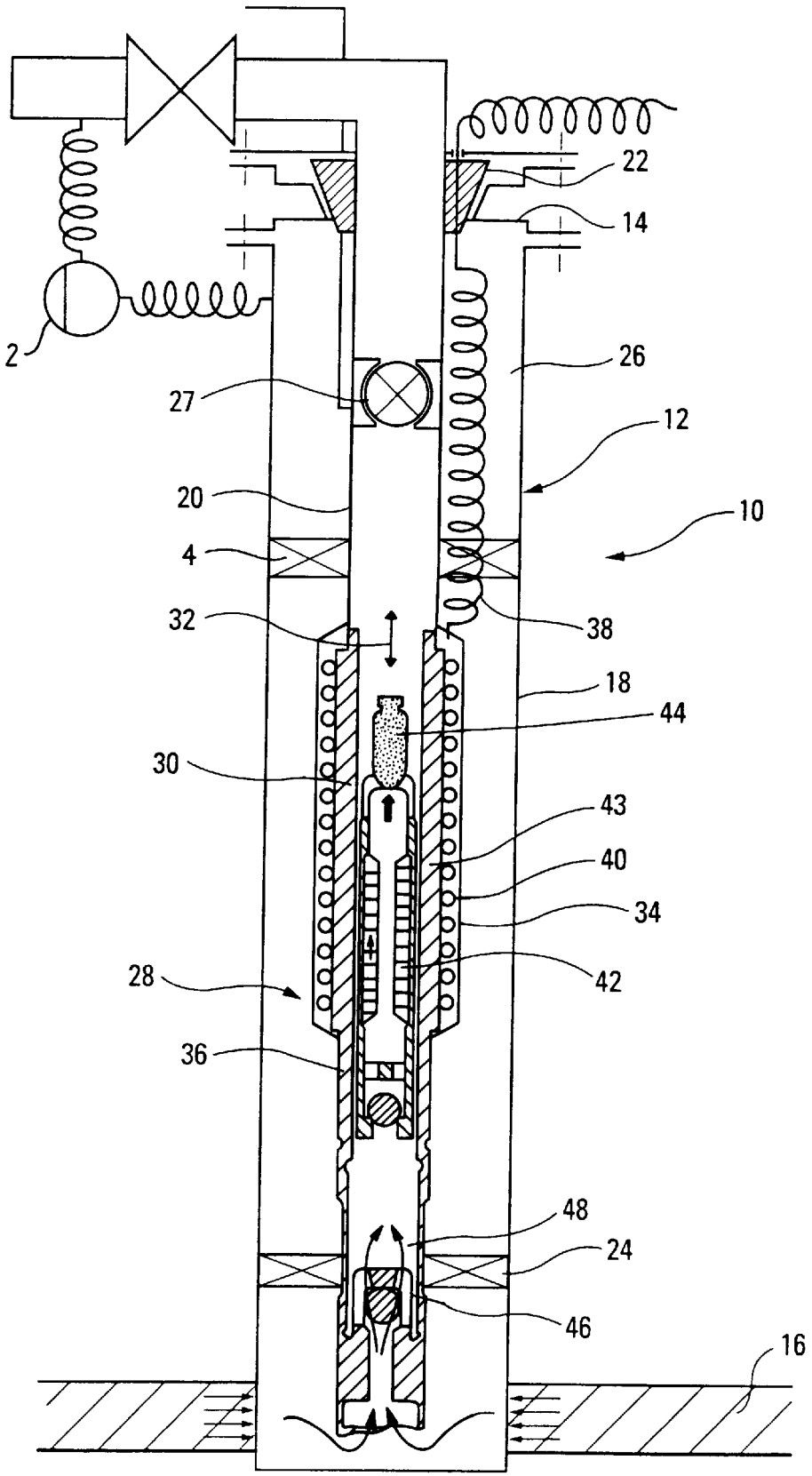
FIG. 1 is a cross-sectional diagrammatical view of an oilwell provided with an electric pump having a linear motor according to the invention.

FIG. 1 shows, indicated generally by 10, a plant for an oilwell in which a well 12 extends between the surface 14 and an oil-bearing rock stratum 16. The well 12 includes a casing 18 which seals the well with respect to the rock strata through which the well passes. Extending inside the well is a production tubing 20, between a wellhead, shown diagrammatically at 22, and a seal 24, more commonly called a packer, which is placed, for example, approximately 100 m above the level of the oil-bearing rock 16. A sealed chamber 26 is defined between the outer wall of the tubing 20 and the inner wall of the casing 18. A safety valve 27 is placed in the tubing 20 approximately 50 m from the surface 14.

In the example illustrated, the tubing 20 includes, near its lower end, an electric pump, indicated generally by 28, which comprises a reciprocating pump 30 intended to be actuated in the direction of the arrow 32 by a linear electric motor 34. The linear electric motor 34, which in the example illustrated is a three-phase motor, is supplied from the surface 14 via a power cable 38 placed in the chamber 26.

If the linear motor 34 used is a single-phase motor, the power may be supplied from a source 2 via the tubing 20 and the casing 18, these being insulated from each other by non-conducting separators 4. Such a power supply makes it possible to dispense with the use of the cable 38.

The linear motor 34 comprises a stator 40 and a moving component 42 which can be moved under the effect of the magnetic field generated by the stator. The stator 40 is mounted on the outside of the tubing 20 inside the chamber 26. The tubing 20, at least in the region 43 neighbouring the linear motor 34, is formed from magnetic material, chosen for example from ceramic, bronze or chromium.

The moving component 42 and the part 43 of the tubing are designed and dimensioned so as to allow removal of the moving component 42 from the tubing. The moving component 42 is provided on its upper end with an attachment head 44 which enables it to be raised to the surface, for example by means of a cable or of a small-diameter tube, more commonly called "coiled tubing".

The lower end of the tubing 20 is provided with a non-return valve 46 which allows the flow of fluid coming from the oil-bearing stratum 16 to the electric pump 28 in the direction of the arrows 48. This valve may advantageously be designed so as to allow it to be raised to the surface by means of a cable.

Figure 2:
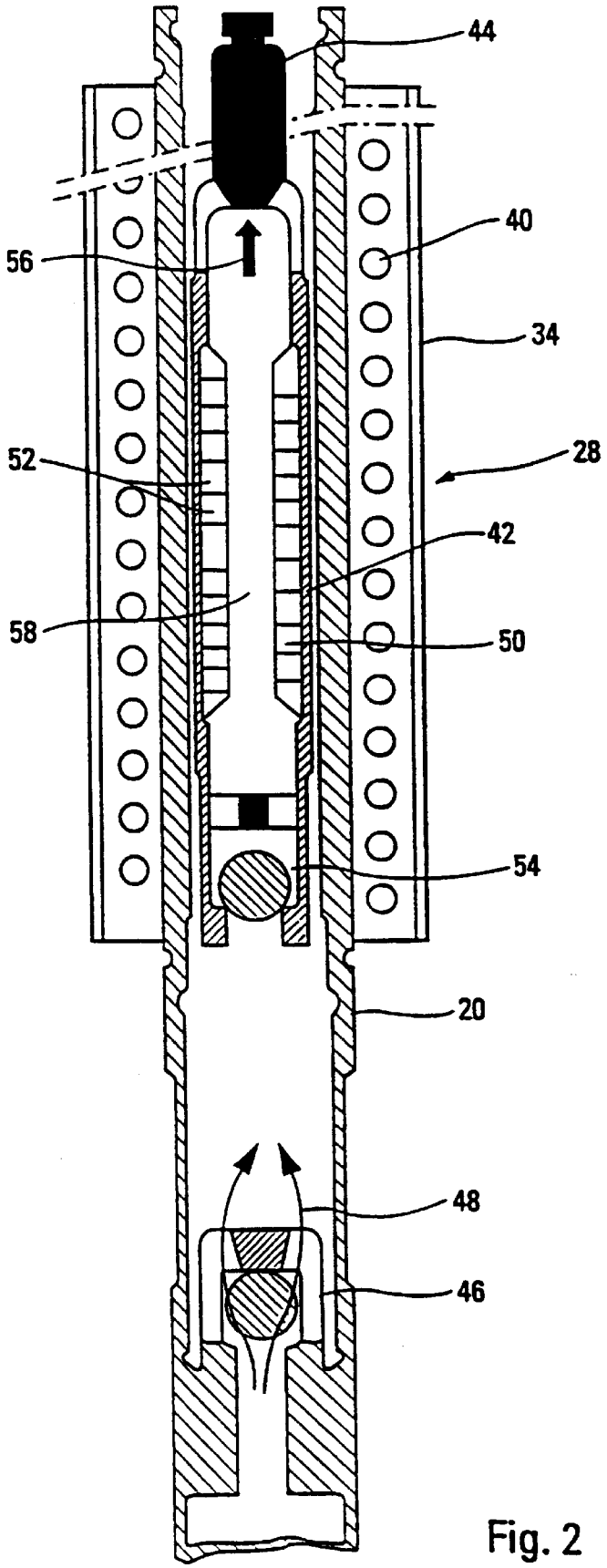
FIG. 2 is a cross-sectional diagrammatic view of an electric pump having a linear motor according to the invention.

As shown in more detail in FIG. 2, and according to the invention, the moving component 42 of the linear motor 34 also forms the piston of the electric pump 28. This moving component 42 comprises an armature 50 formed, for example, by several laminated magnetic sections 52 preferably made of soft iron. At its lower end, the moving component has a non-return valve 54 allowing fluid coming from the bottom of the well to pass up to the surface. This configuration is particularly propitious with regard to the pumping efficiency when the effluent contains large proportions of gas. However, the non-return valve may, alternatively, be mounted on the upper end of the moving component. This type of arrangement may be used particularly when the effluent to be pumped contains little or no gas. When the linear motor is energized, the moving component 42 is set in axial motion in the direction of the arrow 56, moving the fluid present in the tubing 20 towards the surface 14. The moving component then goes back down to its initial position, as close as possible to the lower end of the tubing 20, the non-return valve 54 opening so as to allow the fluid present between the non-return valve 48, which is closed, and the piston of the electric pump, to pass through the moving component 42 via an axial passage 58. The moving component can go back down under the effect of its deadweight, or by actuating the linear motor in the reverse direction.

The period of one pumping cycle depends on the axial length of the stator. Optionally, this length may exceed 10 m. A long stroke of the electric pump piston has the advantage of reducing the number of operations of the non-return valves 46 and 54. A long electric pump stroke is particularly recommended when the effluent pumped is heavy crude or crude with a high gas content.

The non-return valve 54, or working valve, is placed at the lower end of the moving component 42 which forms the piston of the electric pump 28. When the moving component 42 is in its lowermost position, i.e. when this component is as close as possible to the non-return valve 46, the dead volume between the two valves is reduced to a minimum. This has the result of increasing the efficiency of the pump.

The speed of displacement of the piston of the electric pump may be varied depending on the characteristics of the effluent to be pumped, using a variable-frequency unit placed in the circuit for supplying power to the stator.

The linear motor 34 is cooled by the extracted effluent which passes through the axial passage 58. The chamber 26, containing the stator 40 and the power cable 38, may, in a preferred embodiment, receives a dielectric substance, a liquid or a gel, so as to increase the durability of the plant. The use of a gel also has the advantage of thermally insulating the tubing, which thus retains all the heat of the fluid, including that received from the motor, as well as that dissipated by the cable 38 which runs along the tubing, the latter acting as a cooling radiator. This thermal insulation will ensure a superior overall energy efficiency of the unit, facilitating the flows.

The lubrication between the moving parts and fixed parts is performed by suitable non-magnetic materials (ceramic, zirconium, Teflon, carbides or bronze) and/or by a film of effluent put into place by a hydrodynamic effect. A parallel lubrication system could also be put into place.

The pump may be provided just as easily placed under the motor as above it, thereby offering greater flexibility in the configuration of the completions, and possible improvements in the case of certain types of effluents, in particular viscous or gas-containing effluents, which are profitable in terms of the production performance of the well.

We claim:

1. Electric pump which comprises a linear motor, formed by a stator and a moving component which can be moved under the effect of the electro-magnetic field generated by the stator, a pump piston which can be moved inside the stator by the linear motor of the electric pump and constituting the moving component of the linear motor, the piston including a non-return valve, the electric pump comprising, in addition, a non-return valve fixed in relation to the piston herein the non-return valve is placed on the end of the piston so as to reduce to a minimum the dead volume between the two non-return valves.

2. Electric pump according to claim 1, wherein the piston is designed so as to allow it to be removed from the stator.

3. Electric pump according to claim 2, wherein the piston is provided with an attachment head allowing it to be removed from a well separately from the stator by means of a cable.

4. A plant for an oil well, extending from the surface to an oil-bearing rock stratum comprising a tubing placed in the well and forming a flow channel to the surface for hydrocarbons coming from the oil-bearing rock stratum, a pump placed in the tubing and comprising a piston, forming the moving component of a linear motor with a stator, the piston being arranged inside the stator and including a non-return valve, the plant comprising, in addition, a non-return valve which is fixed relative to the piston wherein the non-return valve is placed on the end of the piston so as to reduce to a minimum the dead volume between the two non-return valves.

5. Plant according to claim 4, wherein the linear motor is a single-phase motor, the power being supplied via the tubing and the casing, these being insulated from each other by separators.

6. Plant according to claim 5, wherein it comprises, in addition, a variable-frequency unit placed in the circuit for supplying the linear motor so as to vary the speed of displacement of the piston.

7. Plant according to claim 4 wherein it comprises, in addition, a variable-frequency unit placed in the circuit for supplying the linear motor so as to vary the speed of displacement of the piston.

* * * * *